US007618759B2

(12) United States Patent
Nishimura

(10) Patent No.: US 7,618,759 B2
(45) Date of Patent: Nov. 17, 2009

(54) ELECTROPHOTOGRAPHIC PHOTOSENSITIVE MEMBER, AND IMAGE FORMING APPARATUS USING SAME

(75) Inventor: Kazuto Nishimura, Higashiomi (JP)

(73) Assignee: Kyocera Corporation, Kyoto (JP)

( * ) Notice: Subject to any disclaimer, the term of this patent is extended or adjusted under 35 U.S.C. 154(b) by 453 days.

(21) Appl. No.: 11/692,786

(22) Filed: Mar. 28, 2007

(65) Prior Publication Data

US 2007/0231719 A1 Oct. 4, 2007

(30) Foreign Application Priority Data

Mar. 30, 2006 (JP) ..... 2006-096029
Feb. 28, 2007 (JP) ..... 2007-049846

(51) Int. Cl.
*G03G 15/04* (2006.01)

(52) U.S. Cl. ..... 430/69; 430/56

(58) Field of Classification Search ..... 430/69, 430/56

See application file for complete search history.

(56) References Cited

FOREIGN PATENT DOCUMENTS

| | | |
|---|---|---|
| JP | 05-313392 | 11/1993 |
| JP | 06-273958 | 9/1994 |
| JP | 07-227630(A) | 8/1995 |
| JP | 07-234609(A) | 9/1995 |
| JP | 08-095275(A) | 4/1996 |
| JP | H08-095275 | 4/1996 |
| JP | 08-146625(A) | 6/1996 |
| JP | H08-146625 | 6/1996 |
| JP | 10-186698 | 7/1998 |
| JP | 11-242349 | 9/1999 |
| JP | 11-338310(A) | 12/1999 |
| JP | 2005-141120 | 6/2005 |

*Primary Examiner*—Mark A Chapman
(74) *Attorney, Agent, or Firm*—Hogan & Hartson LLP

(57) ABSTRACT

The present invention relates to an electrophotographic photosensitive member including a cylindrical body and a photosensitive layer. The cylindrical body has provided with an outer circumference, end surfaces and chamfers formed therebetween. The photosensitive layer is formed on the outer circumference of the cylindrical body. The photosensitive layer covers the chamfers. The chamfers have a surface roughness larger than the outer circumference. Preferably, the end surfaces have a surface roughness larger than the outer circumference.

12 Claims, 6 Drawing Sheets

ELECTROPHOTOGRAPHIC PHOTOSENSITIVE MEMBER, AND IMAGE FORMING APPARATUS USING SAME

CROSS-REFERENCE TO RELATED APPLICATIONS

The present application claims priority under 35 U.S.C. §119 to Japanese Patent Application No. 2006-096029, filed Mar. 30, 2006, No. 2007-049846, filed Feb. 28, 2007 entitled "ELECTROPHOTOGRAPHIC PHOTOSENSITIVE MEMBER, AND IMAGE FORMING APPARATUS USING SAME." The contents of this application are incorporated herein by reference in their entirety.

BACKGROUND OF THE INVENTION

1. Field of the Invention

The present invention relates to an electrophotographic photosensitive member formed with having a photosensitive layer formed on an outer circumference of a cylindrical body, and an image forming apparatus utilizing electrophotographic method and provided with the electrophotographic photosensitive member.

2. Description of the Related Art

The electrophotographic photosensitive member includes a cylindrical body having an outer circumference formed withon which a photosensitive layer is formed. In such an electrophotographic photosensitive member, since film texture and adhesiveness of the photosensitive layer affects the image property, it is important to adjust them for enhancing improving the image property.

Meanwhile, the film texture and the adhesiveness of the photosensitive layer are affected by surface roughness of the cylindrical body. For example, when making an electrophotographic photosensitive member by forming a photosensitive layer on a surface of a cylindrical body with a relatively large surface roughness, irregularities on the surface of the cylindrical body appear on images and cause roughness of images. Further, when the surface roughness of the cylindrical body is relatively large, anomalous growth in film forming process is generated, which may cause problem such as charge leakage (refer to JP-A-2005-141120, for example).

On the other hand, when making the cylindrical body to have a relatively small surface roughness, the problems caused due to large surface roughness are solved, however, since the adhesiveness of the photosensitive layer relative to the cylindrical body is lowered, peeling of film is likely to be generated. Since mechanical load tends to be applied at the end portions of the electrophotographic photosensitive member, peeling of film is more likely to be generated at the end portions of the electrophotographic photosensitive member. Though the end portions of the electrophotographic photosensitive member does not contribute to image forming, if the peeling of film generated at the end portions extends to the image forming area, the image property may be affected.

Recent years, demand for images of colored colorization, higher quality, and higher speed of images has been increased, and it became mainstream to use amorphous silicon (a-Si) material for the make the photosensitive layers and aluminum for the cylindrical body of amorphous silicon (a-Si) and aluminum, respectively. In this case, a difference in inner stress (or rate of thermal expansion) of between the photosensitive layer and the cylindrical body tends to be increased, so that peeling of film at the outer circumference is more likely to be generated when the surface roughness of the outer circumference of the cylindrical body is relatively small.

As a result, improvement of the image property by adjusting optimizing the film texture and the adhesiveness of the photosensitive layer is limited, and thus cannot sufficiently meet the recent demand for colorization, higher quality, and higher speed of images only by changing the surface roughness of the outer surface of the cylindrical body has limitation in enhancing the image property, and thus cannot reliably meet the recent demand for images of colored, high quality, and high speed.

SUMMARY

An object of the present invention is to provide an electrophotographic photosensitive member for preventing peeling of film at an outer circumference of a cylindrical body, while preventing problems such as charge leakage. The present invention relates to an electrophotographic photosensitive member comprising including a cylindrical body provided with having an outer circumference, end surfaces and chamfers formed therebetween and a photosensitive layer formed on the outer circumference of the cylindrical body. The present invention further relates to an image forming apparatus provided with the electrophotographic photosensitive member. The photosensitive layer covers the chamfers. The chamfers have surface roughness larger than the outer circumference.

DETAILED DESCRIPTION OF THE PREFERRED EMBODIMENTS

An image forming apparatus and an electrophotographic photosensitive member according to the present invention are specifically described below with reference to the accompanying drawings.

Figure 1:
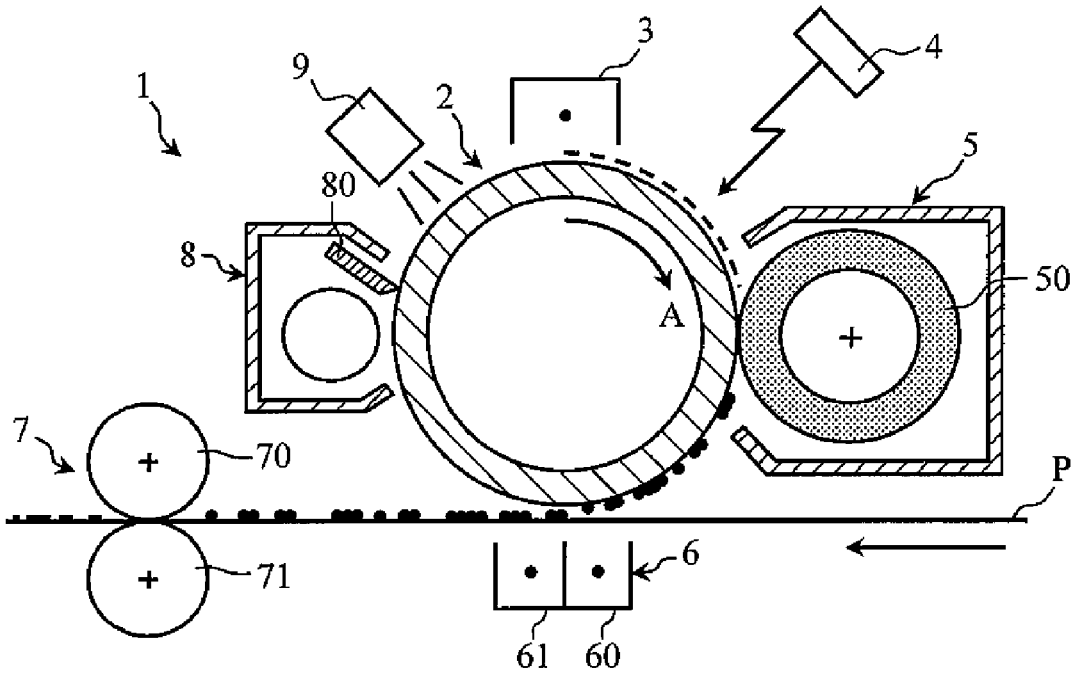
FIG. 1 is a diagram illustrating an example of an image forming apparatus according to an embodiment of the present invention.

An image forming apparatus 1 shown in FIG. 1 includes an electrophotographic photosensitive member 2, an electrification mechanism 3, an exposure mechanism 4, a development mechanism 5, a transfer mechanism 6, a fixing mechanism 7, a cleaning mechanism 8, and a discharging mechanism 9.

The electrophotographic photosensitive member 2 forms an electrostatic latent image or a toner image according to an image signal, and can be rotated in the direction of an arrow A in the figure.

The electrification mechanism 3 constantly charges the surface of the electrophotographic photosensitive member 2 positively or negatively, according to types of photoconductive layer of the electrophotographic photosensitive member 2. The electrification potential at the electrophotographic photosensitive member 2 is normally set to not less than 200V and not more than 1000V.

The exposure mechanism 4 serves to form an electrostatic latent image on the electrophotographic photosensitive member 2, and is capable of emitting light of a predetermined wavelength (not less than 650 nm and not more than 780 nm, for example). The exposure mechanism 4 forms an electrostatic latent image which is an electric potential contrast by emitting light on the surface of the electrophotographic photosensitive member 2 according to an image signal, and lowering the electrical potential at the emitted portion. An example of the exposure mechanism 4 includes a LED head in which LED elements capable of emitting light at a wavelength of e.g. about 680 nm are arranged at 600 dpi.

Of course, the exposure mechanism 4 may be capable of emitting laser light. By replacing the exposure mechanism 4 having LED head with an optical system using e.g. laser light beam, or a polygon mirror or the like, or with an optical system using e.g. a lens, or a mirror or the like through which light reflected at paper is transmitted, the image forming apparatus may have a function of a copying apparatus.

The development mechanism 5 forms a toner image by developing the electrostatic latent image formed on the electrophotographic photosensitive member 2. The development mechanism 5 holds developer and is provided with a developing sleeve 50.

The developer serves to develop a toner image formed on the surface of the electrophotographic photosensitive member 2, and is frictionally charged at the development mechanism 5. The developer may be a binary developer of magnetic carrier and insulating toner, or a one-component developer of magnetic toner.

The developing sleeve 50 serves to transfer the developer to a developing area between the electrophotographic photosensitive member 2 and the developing sleeve 50.

In the development mechanism 5, the toner frictionally charged by the developing sleeve 50 is transferred in a form of magnetic brush with bristles each having a predetermined length. In the developing area between the electrophotographic photosensitive member 2 and the developing sleeve 50, the electrostatic latent image is developed using the toner, thereby forming atoner image. When the toner image is formed by regular developing, the toner image is charged in the reverse polarity of the polarity of the surface of the electrophotographic photosensitive member 2. On the other hand, when the toner image is formed by reverse developing, the toner image is charged in the same polarity as the polarity of the surface of the electrophotographic photosensitive member 2.

The transfer mechanism 6 transfers the toner image of the electrophotographic photosensitive member 2 on a recording medium P supplied to a transfer area between the electrophotographic photosensitive member 2 and the transfer mechanism 6. The transfer mechanism includes a transfer charger 60 and a separation charger 61. In the transfer mechanism 6, the rear side (non-recording surface) of the recording medium P is charged in the reverse polarity of the toner image by the transfer charger 60, and by the electrostatic attraction between this electrification charge and the toner image, the toner image is transferred on the recording medium P. Further, in the transfer mechanism 6, simultaneously with the transfer of the toner image, the rear side of the recording medium P is charged in alternating polarity by the separation charger 61, so that the recording medium P is quickly separated from the surface of the electrophotographic photosensitive member 2.

As the transfer mechanism 6, a transfer roller driven with the rotation of the electrophotographic photosensitive member 2, and being spaced from the electrophotographic photosensitive member 2 by a minute gap (generally, not more than 0.5 mm) may be used. Such a transfer roller applies a transfer voltage to the recording medium P, using, e.g., direct-current power source, for attracting the toner image of the electrophotographic photosensitive member 2 onto the recording medium. In using the transfer roller, a separation member such as the separation charger 61 is omitted.

The fixing mechanism 7 serves to fix a toner image transferred onto the recording medium P, and includes a pair of fixing rollers 70, 71. In the fixing mechanism 7, the recording medium P passes through between the fixing rollers 70, 71, 50 that the toner image is fixed on the recording medium P by heat or pressure.

The cleaning mechanism 8 serves to remove the toner remaining on the surface of the electrophotographic photosensitive member 2, and includes a cleaning blade 80. In the cleaning mechanism 8, the toner remaining on the surface of the electrophotographic photosensitive member 2 is scraped off by the cleaning blade 80 and is collected. The toner collected in the cleaning mechanism 8 is recycled at the development mechanism 5, if necessary.

The discharging mechanism 9 removes surface charge on the electrophotographic photosensitive member 2. The discharging mechanism 9 removes the surface charge of the electrophotographic photosensitive member 2 by, e.g., light irradiation.

Figure 2:
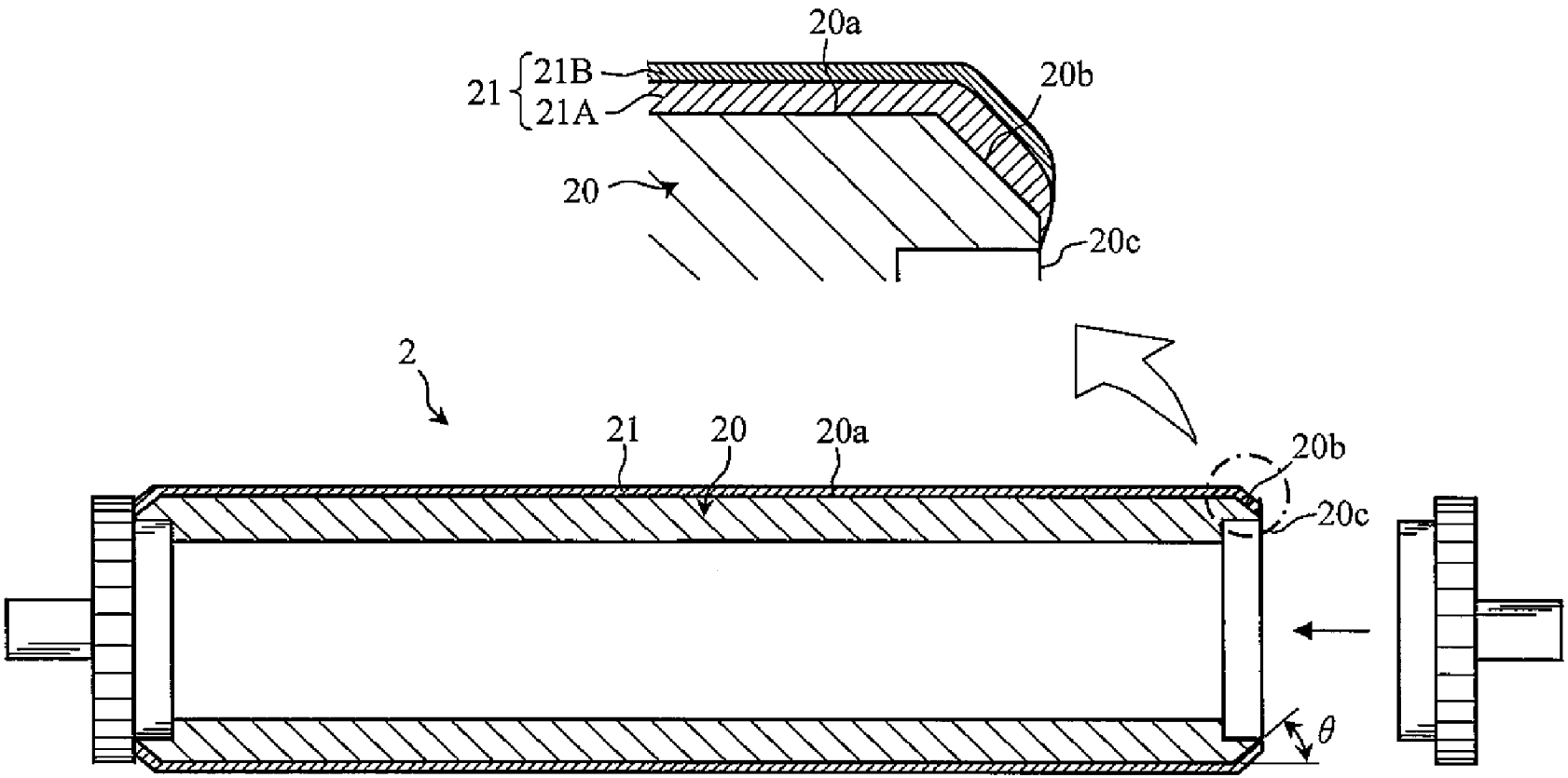
FIG. 2 is a sectional view illustrating an electrophotographic photosensitive member according to an embodiment of the present invention and an enlarged sectional view illustrating the principal portions.

The electrophotographic photosensitive member 2 incorporated in the image forming apparatus 1 is shown in FIG. 2. The illustrated electrophotographic photosensitive member 2 includes a cylindrical body 20 and a photosensitive layer 21.

The photosensitive layer 21 is formed continuously on an outer circumference 20*a*, chamfers 20*b*, and end surfaces 20*c* of the cylindrical body 20, and includes a photoconductive layer 21A and a surface layer 21B. The photosensitive layer 21 may also include an anti-carrier injection layer and a carrier transport layer, if necessary.

In the photoconductive layer 21A, electrons are excited by a light irradiation such as a laser from the exposure mechanism 42, and a carrier of free electrons or electron holes is generated.

The photoconductive layer 21A is formed of an amorphous silicon material amorphous material having silicon atom as a base (a-Si material). The photoconductive layer 21A may also formed of a-Se material such as a-Se, Se—Te, and $As_2Se_3$, or chemical compound of twelfth to sixteenth group elements of the periodic system such as ZnO, CdS, and CdSe. Especially, it is preferable to use a-Si material, such as a-Si and a mixture of a-Si and an element such as C, N, and O. In this way, improved electrophotographic property, such as it is able to have high luminous sensitivity, high-speed responsiveness, stable repeatability, high heat resistance, and high endurance, and so on, thereby reliably obtaining can be reliably obtained enhanced electrophotographic property. Further, conformity of the photoconductive layer with the surface layer 21B is enhanced.

As the a-Si material, a-Si, a-SiC, a-SiN, a-SiO, a-SiGe, a-SiCN, a-SiNO, a-SiCO or a-SiCNO may be used. In forming the The photoconductive layer 21A using the above a-Si material, it can be formed by glow discharge decomposition method, various sputtering methods, various vapor deposition methods, ECR method, photo-induced CVD method, catalyst CVD method, and reactive vapor deposition method, for example. In film forming of the photoconductive layer, hydrogen (H) or a halogen element (F, C1) may be contained in the film by not less than one atom % and not more than 40 atom % for dangling-bond termination. Further, in forming the photoconductive layer 21A, for obtaining a desired property such as electrical property including e.g. dark conductivity and photoconductivity as well as optical bandgap, thirteenth group element of the periodic system (hereinafter referring to as "thirteenth group element") or fifteenth group element of the periodic system (hereinafter referring to as "fifteenth group element"), or an adjusted amount of element such as C, N, and O may be contained.

As the thirteenth group element and the fifteenth group element, in view of high covalence and sensitive change of semiconductor property, as well as of high luminous sensitivity, it is desired to use boron (B) and phosphorus (P) When the thirteenth group element and the fifteenth group element are contained in combination with elements such as C, N, and O, preferably, the thirteenth group element may be contained by not less than 0.1 ppm and not more than 20000 ppm, while the fifteenth group element may be contained by not less than 0.1 ppm and not more than 10000 ppm. When the photoconductive layer contains no elements such as C, N, and O, or contains only a small amount of them, preferably, the thirteenth group element may be contained by not less than 0.01 ppm and not more than 200 ppm, while the fifteenth group element may be contained by not less than 0.01 ppm and not more than 100 ppm. These elements may be contained in a manner such that concentration gradient is generated in the thickness direction of the layers, if the average content of the elements in the layers is within the above-described range.

In forming the photoconductive layer 21A using a-Si material, microcrystal silicon (μc-Si) maybe contained, which enhances dark conductivity and photoconductivity, and thus advantageously increases design freedom of the photoconductive layer 21A. Such μc-Si can be formed by utilizing a method similar to the above-described method, and by changing the film forming condition. For example, when utilizing glow discharge decomposition method, the layer can be formed by setting temperature and high-frequency electricity at the cylindrical body 20 to be relatively high, and by increasing flow amount of hydrogen as diluent gas. Further, impurity elements similar to the above-described elements may be added when μc-Si is contained.

The thickness of the photoconductive layer 21A is set according to the photoconductive material and desired electrophotographic property. When using a-Si material, the thickness is normally set to not less than 5 μm and not more than 100 μm, preferably, not less than 15 μm and not more than 60 μm.

It is preferable that variation in thickness of the photoconductive layer 21A in the axial direction is set within ±3% relative to the thickness at the intermediate portion. If the variation in thickness of the photoconductive layer 21A is relatively large, variation may be generated in the withstand pressure (or leakage) and the outer diameter of the electrophotographic photosensitive member 2, so that problem in image may be caused in the axial direction.

The photoconductive layer 21A may be also formed by changing the above-described inorganic material into particles and dispersing the particles in a resin, or may be formed as an OPC photoconductive layer.

The surface layer 21B serves to enhance quality and stability of electrophotographic property (i.e. potential characteristic such as charging characteristic, optical sensitivity and residual potential, and image characteristic such as image density, image resolution, image contrast and image tone), as well as durability (against friction, wear, environment and chemical) in the electrophotographic photosensitive member 2.

The surface layer 21B is laminated on the surface of the photoconductive layer 21A, using an amorphous silicon material (a-SiC material) containing at least not less than 50 atom % of carbon. The surface layer 21B has a thickness of not less than 0.2 μm and not more than 1.5 μm, preferably not less than 0.5 μm and not more than 1.0 μm. Such a surface layer 21B may be formed by the same method as the photoconductive layer 21A.

The cylindrical body 20 forms the skeleton of the electrophotographic photosensitive member 2 and is made of a conductive material as a whole. The conductive material for forming the cylindrical body 20 may include metal such as Al, SUS, Zn, Cu, Fe, Ti, Ni, Cr, Ta, Sn, Au, and Ag, and an alloy of these metals, for example. Among the above-described conductive materials, Al material is most preferable. By making the cylindrical body 20 using Al alloy material, the electrophotographic photosensitive member 2 having a light weight can be made at a low cost, and further, when forming the photoconductive layer 21 using a-Si material, the adhesion between the cylindrical body and an layer is reliably enhanced.

The chamfers 20*b* of the cylindrical body 20 are provided between the outer circumference 20*a* and the end surfaces 20*c*.

Each of the chamfers 20*b* is a corner flat surface and its crossing angle θ relative to the outer circumference 20*a* is set to not less than 30 degrees and not more than 60 degrees. By setting the crossing angle between the chamfer 20*b* and the outer circumference 20*a* within the above range, the edge between the chamfer 20*b* and the outer circumference 20*a* as well as the edge between the chamfer 20*b* and respective one of the end surfaces 20*c* can be formed at an obtuse angle. Thus, when forming the photosensitive layer 21 continuously from the outer circumference 20*a* to the chamfer 20*b*, or from the outer circumference 20*a* to the end surface 20*c*, the photosensitive layer 21 is prevented from being damaged by the edges.

Figure 3:
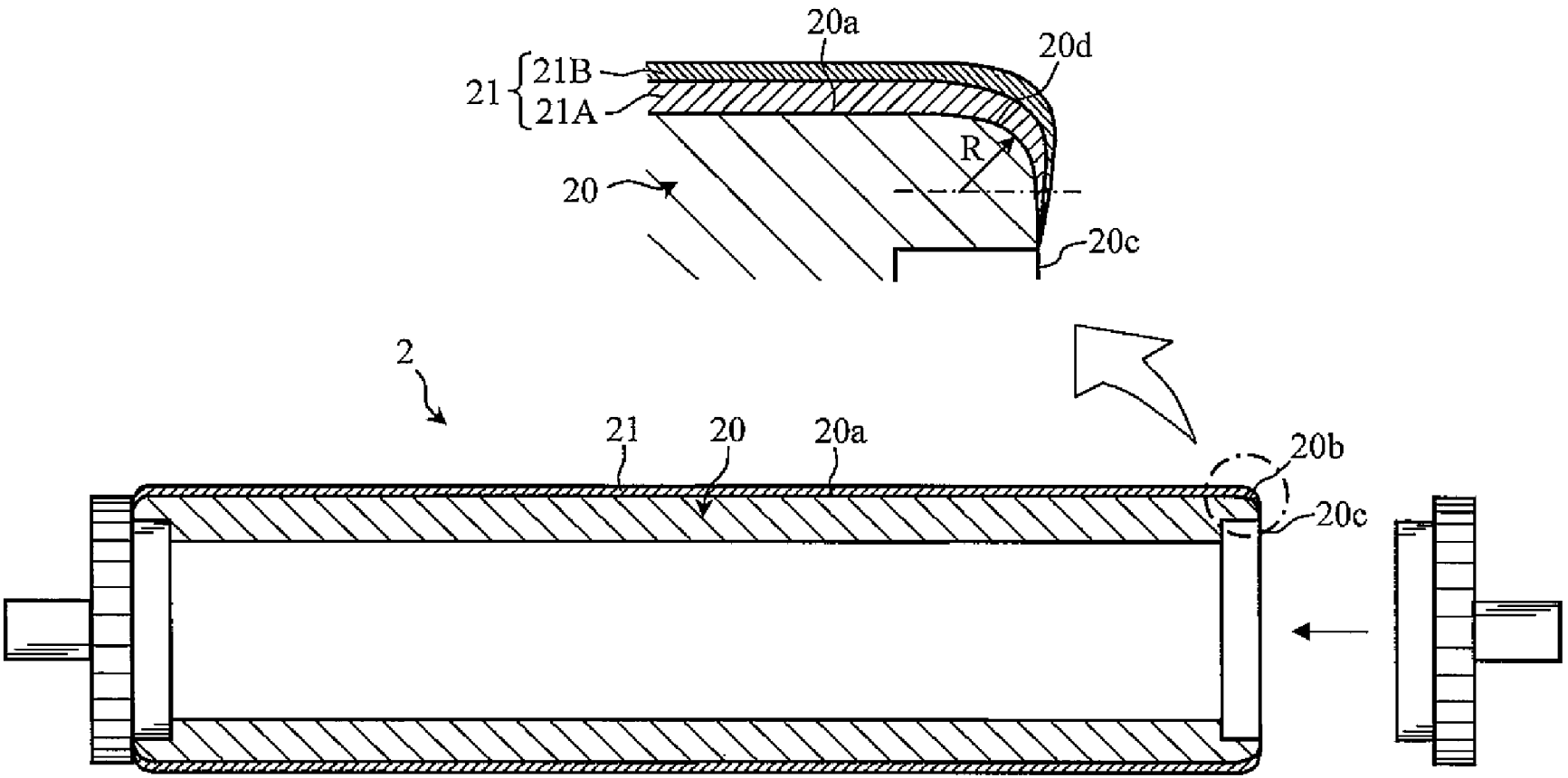
FIG. 3 is a sectional view corresponding to FIG. 2, for illustrating another example of the electrophotographic photosensitive member according to an embodiment of the present invention and an enlarged sectional view illustrating the principal portions.

As shown in FIG. 3, a chamfer 20*d* may be formed into a rounded surface. In this case, the curvature radius R of the chamfer 20*d* is set to not less than 0.1 mm and not more than 1.5 mm, for example. By setting the curvature radius R of the chamfer 20*d* within the above range, when forming the photosensitive layer 21 continuously from the outer circumference 20*a* to the chamfer 20*d*, or from the outer circumference 20*a* to the end surface 20*c*, the photosensitive layer 21 is prevented from being damaged by the edge between the chamfer 20*d* and the outer circumference 20*a* or the end surface 20*c*. As a result, the photosensitive layer 21 is prevented from peeling off at the end portions.

The surface roughness of the chamfer 20*b*, 20*d* is set to be larger than the outer circumference 20*a*, and preferably, larger than the end surface 20C. The surface roughness of the chamfer 20*b*, 20*d* may be smaller than the end surface 20*c*.

Here, in the cylindrical body 20, the outer circumference 20*a* is a mirror surface having an arithmetic mean roughness Ra of not less than 0.010 μm and not more than 0.050 μm, and the chamfer 20*b*, 20*d* and the end surface 20*c* are rough surfaces having an arithmetic mean roughness Ra of not less than 0.100 μm. Preferably, the chamfer 20*b*, 20*d* and the end surface 20*c* have an arithmetic mean roughness Ra of not less than 0.100 μm and not more than 1.000 μm.

By forming the outer circumference 20*a* of the cylindrical body 20 as a mirror surface, anomalous growth in forming the photosensitive layer 21 can be prevented, and thus the photosensitive layer 21 can be formed to have a high smoothness. As a result, the photosensitive layer 21 can be prevented from problem such as charge leakage.

Meanwhile, by forming the chamfer 20*b*, 20*d* into a rough surface having a surface roughness larger than that of the outer circumference 20*a*, with an arithmetic mean roughness Ra of e.g. not less than 0.100 μm, adhesiveness of the photosensitive layer 21 at the chamfer 20*b*, 20*d* is enhanced. Thus, the photosensitive layer 21 is prevented from peeling off at the end portions and thus at the outer circumference 20*a*. Still further, by forming the chamfer 20*b*, 20*d* to have an arithmetic mean roughness Ra of not more than 1.000 μm, burrs can be prevented from being generated at the end portions during film forming process. In this way, defective product rate can be reduced, thereby reducing the product cost.

By forming the end surface 20*c* into a rough surface having a surface roughness larger than that of the outer circumference 20*a*, with an arithmetic mean roughness Ra of not less than 0.100 μm, for example, when forming the photosensitive layer 21 continuously to the end surface 20*c*, adhesiveness of the photosensitive layer 21 at the end surface 20*c* is enhanced. Thus, the photosensitive layer 21 is prevented from peeling off at the end portions and thus at the outer circumference 20*a*. Still further, by forming the end surface 20*c* to have an arithmetic mean roughness Ra of not more than 1.000 μm, burrs can be prevented from being generated at the end portions during film forming process. In this way, defective product rate can be reduced, thereby reducing the product cost.

Especially when forming the photosensitive layer 21 continuously to the end surface 20*c*, by forming the chamfer 20*b*, 20*d* to have a surface roughness larger than that of the end surface 20*c*, adhesiveness of the photosensitive layer 21 at the chamfer 20*b*, 20*d* is enhanced. Thus, even if peeling off is generated at the end surface 20*c*, it can be prevented at the chamfer 20*b*, 20*d*. As a result, peeling off is reliably prevented from extending to the outer circumference 20*a*. On the other hand, when forming the photosensitive layer 21 continuously to the end surface 20*c*, by forming the chamfer 20*b*, 20*d* to have a surface roughness larger than that of the end surface 20*c*, burr generated in forming the photosensitive layer 21 can be prevented.

Figure 4:
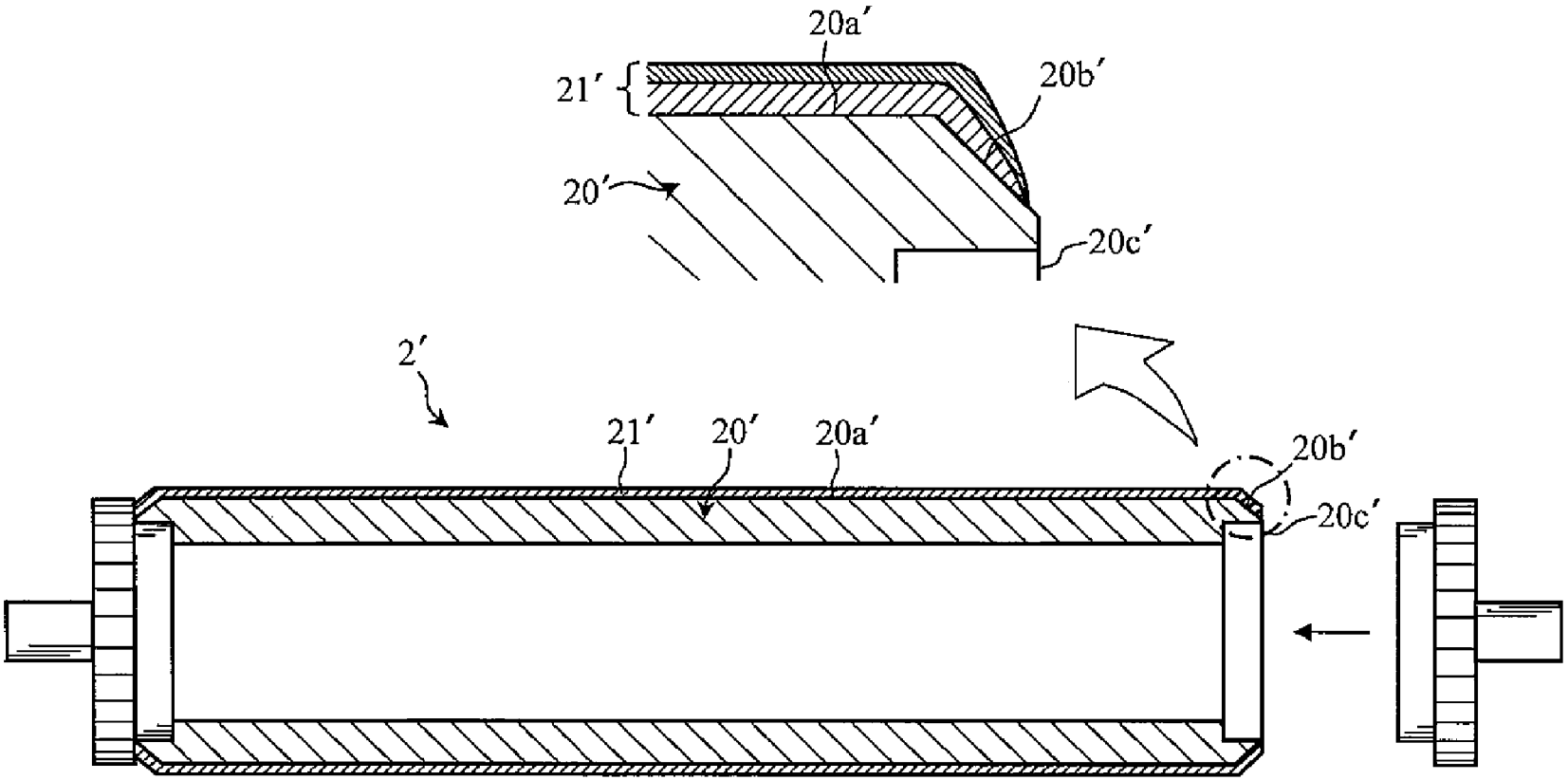
FIG. 4 is a sectional view corresponding to FIG. 2, for illustrating still another example of the electrophotographic photosensitive member according to another embodiment of the present invention and an enlarged sectional view illustrating the principal portions.

The present invention is not limited to the above-described embodiments, but may be changed variously. For example, as the electrophotographic photosensitive member 2' shown in FIG. 4, the photosensitive layer 21' may be formed to extend to the chamfer 20*b*' without extending to the end surface 20*c*'. In this case, the surface roughness of the chamfer 20*c*' is also set to be larger than that of the outer circumference 20*a*'. In FIG. 4, the chamfer 20*b*' is a cornera flat surface, but may be a rounded surface.

EXAMPLE

In the present example, it was studied how the surface roughness of the chamfer 20*b* and the end surface 20*c* of the cylindrical body 20 affects adhesiveness of the photosensitive layer 21 when using the electrophotographic photosensitive member 2 shown in FIG. 2.

(Manufacture of Electrophotographic Photosensitive Member)

The cylindrical body 20 of the electrophotographic photosensitive member used in the present example was manufactured by preparing a drawn tube with an outer diameter of 30 mm and a length of 254 mm, using an aluminum alloy. The outer circumference 20*a* was mirror finished and surface roughness of each of the chamfers 20*b* and the end surfaces 20*c* was adjusted. After cleaning, the cylindrical body was incorporated in a glow-discharge-decomposition film-forming apparatus, and the photosensitive layer 21, including the anti-carrier injection layer, the photoconductive layer 21A, and the surface layer 21B laminated in this order, was formed under film forming conditions shown in the following Table 1.

TABLE 1

| Layers | | Anti-charge Injection Layer | Photoconductive Layer | Surface Layer |
|---|---|---|---|---|
| Gas Flow Amount | $SiH_4$ [sccm] | 105 | 116 | 5-300 |
| | $B_2H_6$ | 0.13% | 1.3→0.2 ppm | — |
| | NO* | 12.3% | — | — |
| | $H_2$ [sccm] | 175 | 160 | 350 |
| | $CH_4$ [sccm] | — | — | 300 |
| Gas Pressure [Pa] | | 60 | 76 | 73 |
| Temperature of Body [° C.] | | 270 | 270 | 270 |
| High-Frequency Electricity [W] | | 100 | 130 | 155 |
| Film Thickness [μm] | | 3.0 | 30.0 | 0.8 |

Note:
Values of gas flow amount and high-frequency electricity are for one CH (one film forming vessel)
*ratio of gas flow amount to that of $SiH_4$ (Measurement of Surface Roughness)

As the surface roughness of the cylindrical body 20, arithmetic mean roughness Ra was measured at the outer circumference 20*a*, the chamfer 20*b*, and the end surface 20*c*. The arithmetic mean roughness Ra was measured in conformity with JIS B0601 (1994). Measurement was performed by aA measuring apparatus "SURFCOM 480A" (manufactured by Tokyo Seimitsu Co., Ltd.) was used for measurement. As a stylus, "0102506" (manufactured by Tokyo Seimitsu Co., Ltd. ) was used. Measurement conditions for measuring the arithmetic mean roughness Ra is shown in the following Table 2. Measurement results of the arithmetic mean roughness Ra are shown in the following Table 3 together with evaluation of adhesiveness of the photosensitive layer 21, which is to be described later. The following Table 4 shows explanation of marks used in Table 3.

TABLE 2

| Measurement Conditions | | | | |
|---|---|---|---|---|
| Measurement Speed | Cutoff Value | Type of Filter | Cutoff Ratio | Measurement Environment |
| 0.03 mm/s | 0.08 mm | Gaussian | 1000 | 20.5° C., 46% RH |

(Evaluation of Adhesiveness of Photosensitive Layer)

Figure 5:
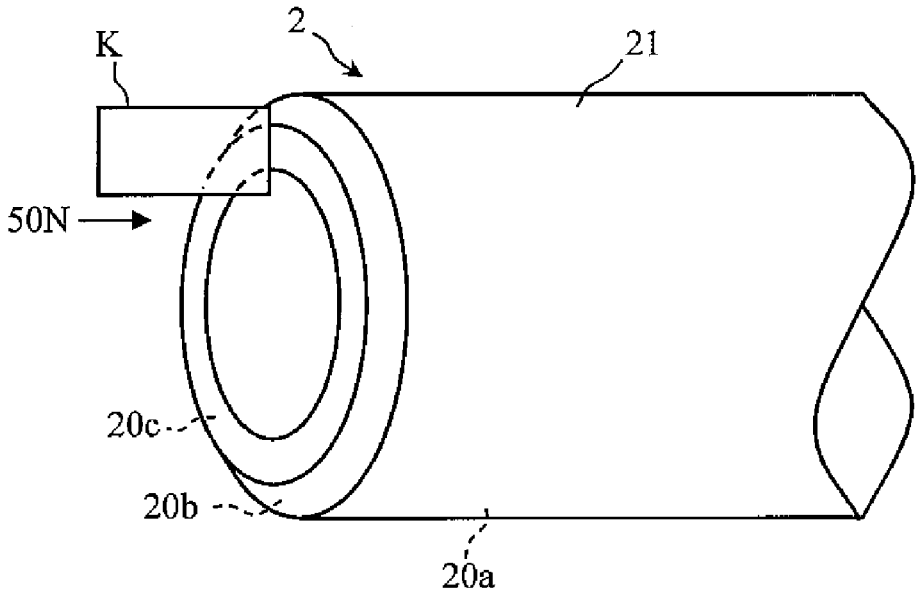
FIG. 5 is a perspective view of the principal portions of the electrophotographic photosensitive member, for illustrating scratching of photosensitive layer in the example.
Figure 6:
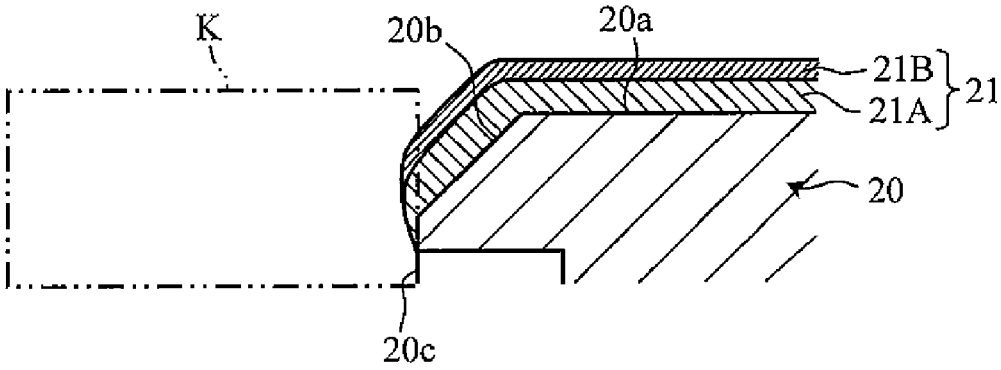
FIG. 6 is a sectional view of the principal portions of the electrophotographic photosensitive member, for illustrating scratching of photosensitive layer in the example.
Figure 7:
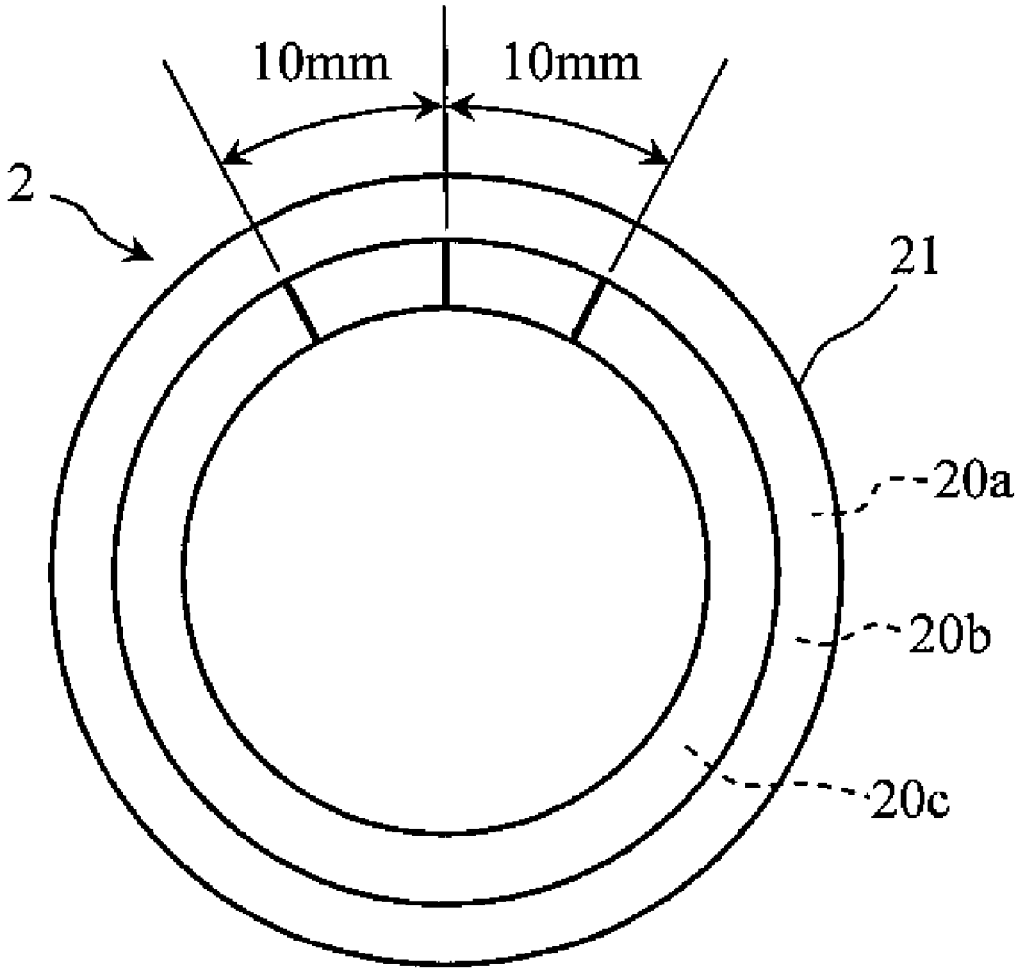
FIG. 7 is a front view illustrating the electrophotographic photosensitive member used in the example.

Evaluation of adhesiveness of the photosensitive layer 21 was performed by scratching the photosensitive layer 21 at portions formed on the end surface 20*c* of the cylindrical body 20, immersing such the electrophotographic photosensitive member 2 into pure water of 20° C. for 24 hours, and then checking observing peeling of film at the outer circumference 20*a* of the photosensitive layer 21. As shown in FIGS. 5 and 6, scratching of the photosensitive layer was performed by pressing a cutter K ("SC-1P" manufactured by NT Incorporated) at 50N onto the end surface of the electrophotographic photosensitive member 2. As shown in FIG. 7, the scratches were provided at three portions per one electrophotographic photosensitive member 2, to extend radially from the axis of the cylindrical body 20 at intervals of 10 mm in the circumferential direction.

Checking Observation results of peeling of film are shown Table 3. Table 3 also shows checking observation results burr generated in forming process of the electrophotographic photosensitive member 2.

TABLE 3

| | | Arithmetic Mean Roughness Ra (μm) | | | | | |
|---|---|---|---|---|---|---|---|
| Sample No. | | Outer Circumference | Chamfer | End Surface | Peeling of Film | Burr | Comprehensive Evaluation |
| 1 | A | 0.023 | 0.029 | 0.048 | x | ○ | x |
| | B | 0.046 | 0.031 | 0.145 | x | ○ | x |
| | C | 0.031 | 0.034 | 0.310 | x | ○ | x |
| | D | 0.019 | 0.029 | 0.703 | x | ○ | x |
| | E | 0.039 | 0.036 | 1.521 | x | x | x |
| 2 | A | 0.046 | 0.152 | 0.032 | x | ○ | x |
| | B | 0.038 | 0.138 | 0.137 | Δ | ○ | Δ |
| | C | 0.030 | 0.163 | 0.379 | Δ | ○ | Δ |
| | D | 0.043 | 0.157 | 0.818 | Δ | Δ | Δ |
| | E | 0.029 | 0.148 | 1.796 | Δ | x | x |
| 3 | A | 0.021 | 0.323 | 0.041 | x | ○ | x |
| | B | 0.043 | 0.351 | 0.151 | ○ | ○ | ○ |
| | C | 0.038 | 0.379 | 0.368 | Δ | ○ | Δ |
| | D | 0.029 | 0.342 | 0.751 | Δ | ○ | Δ |
| | E | 0.045 | 0.340 | 1.592 | Δ | x | x |
| 4 | A | 0.032 | 0.688 | 0.036 | x | ○ | x |
| | B | 0.041 | 0.712 | 0.172 | ○ | ○ | ○ |
| | C | 0.018 | 0.734 | 0.334 | ○ | Δ | Δ |
| | D | 0.029 | 0.751 | 0.821 | Δ | Δ | Δ |
| | E | 0.037 | 0.729 | 1.603 | Δ | x | x |
| 5 | A | 0.025 | 1.621 | 0.050 | x | x | x |
| | B | 0.048 | 1.674 | 0.156 | ○ | x | x |
| | C | 0.036 | 1.599 | 0.411 | ○ | x | x |
| | D | 0.037 | 1.631 | 0.792 | ○ | x | x |
| | E | 0.044 | 1.658 | 1.588 | Δ | x | x |

TABLE 4

| Explanation of Marks | | |
|---|---|---|
| Peeling of Film | ○ | Good without peeling of film |
| | Δ | Usable with slight peeling of film |
| | x | Unusable with large peeling of film |
| Burr | ○ | Good without burr |
| | Δ | Usable with slight burr |
| | x | Unusable with large burr |
| Comprehensive Evaluation | ○ | Good |
| | Δ | Usable |
| | x | Unusable |

Based on the results shown in Table 3, relationship between surface roughness of the chamfer and the end surface and peeling of film at the outer circumference is shown in Table 5, while relationship between surface roughness of the chamfer and the end surface and generation of burr is shown in Table 6.

TABLE 5

Relationship between Roughness at Chamfer and End Surface and Peeling of Film at Outer Circumference

| | End Surface | | | | |
|---|---|---|---|---|---|
| Chamfer | ~0.100 μm | 0.100~ 0.300 μm | 0.300~ 0.600 μm | 0.600~ 1.000 μm | 1.000 μm~ |
| ~0.100 μm | x | x | x | x | x |
| 0.100~ 0.300 μm | x | Δ | Δ | Δ | Δ |
| 0.300~ 0.600 μm | x | ○ | Δ | Δ | Δ |
| 0.600~ 1.000 μm | x | ○ | ○ | Δ | Δ |
| 1.000 μm~ | x | ○ | ○ | ○ | Δ |

TABLE 6

Relationship between Roughness at Chamfer and End Surface and Burr

| | End Surface | | | | |
|---|---|---|---|---|---|
| Chamfer | ~0.100 μm | 0.100~ 0.300 μm | 0.300~ 0.600 μm | 0.600~ 1.000 μm | 1.000 μm~ |
| ~0.100 μm | ○ | ○ | ○ | ○ | x |
| 0.100~ 0.300 μm | ○ | ○ | ○ | Δ | x |
| 0.300~ 0.600 μm | ○ | ○ | ○ | ○ | x |
| 0.600~ 1.000 μm | ○ | ○ | Δ | Δ | x |
| 1.000 μm~ | x | x | x | x | x |

As can be seen from Table 5, when the arithmetic mean roughness Ra of the chamfer 20*b* and the end surface 20*c* was not more than 0.100 μm, peeling of film was generated at the end surface 20*c* and extends to the outer circumference 20*a*, which is unsuitable for practical use. The above results can be also seen from Table 3, however, in the samples A, C, D of No. 1, sample A of No. 2, sample A of No. 3, sample A of No. 4, and sample A of No. 5 each having a surface roughness larger at the chamfer 20*b* than at the outer circumference 20*a*, though being unsuitable for practical use, peeling of film was less likely to be generated in comparison with the samples each having a surface roughness smaller at the chamfer 20*b* than at the outer circumference 20*a*.

On the other hand, as can be seen from Table 5, when the arithmetic mean roughness Ra of the chamfer 20*b* and the end surface 20*c* was not less than 0.100 μm, peeling of film was not generated at the outer circumference 20*a*, or a slight peeling of film was generated but without interfering with practical use.

Among the electrophotographic photosensitive members 2 with good results in peeling of film as shown in Table 3, in the samples each having arithmetic mean roughness Ra larger at the chamfer 20*b* than at the end surface 20*c*, peeling of film was not generated at the outer circumference 20*a* in the samples each having arithmetic mean roughness Ra larger at the chamfer 20*b* than at the end surface 20*c*.

Thus, in view of preventing peeling of film at the outer circumference 20*a*, it is preferable that the arithmetic mean roughness Ra of the chamfer 20*b* and the end surface 20*c* is not less than 0.100 μm, and more preferably, the arithmetic mean roughness Ra may be larger at the chamfer 20*b* than at the end surface 20*c*.

As can be seen from Table 6, when the arithmetic mean roughness Ra of the chamfer 20*b* and the end surface 20*c* was not less than 1.000 μm, a burr was generated in film forming process, which is unsuitable for practical use.

On the other hand, when the arithmetic mean roughness Ra of the chamfer 20*b* and the end surface 20*c* was not more than 1.000 μm, a burr was not generated in film forming process, or a slight burr was generated but without interfering with practical use.

Thus, in view of preventing burr in film forming process, it is preferable that the arithmetic mean roughness Ra of the chamfer 20*b* and the end surface 20*c* is not more than 1.000 μm.

Among the electrophotographic photosensitive members 2 with good results in burr in film forming process as shown in Table 3, in the samples each having arithmetic mean roughness Ra smaller at the chamfer 20*b* than at the end surface 20*c*, results in peeling of film was also likely to be good.

In consideration of the above results, for preventing burr in film forming process as well as peeling of film at the outer circumference, it is preferable that the arithmetic mean roughness Ra of the chamfer 20*b* and the end surface 20*c* is set to be in a range of 0.100-1.000 μm. Especially when the arithmetic mean roughness Ra of the chamfer 20*b* is larger than at the end surface 20*c*, peeling of film at the outer circumference 20*a* can be prevented reliably.

The invention claimed is:

1. An electrophotographic photosensitive member comprising:

a cylindrical body having an outer circumferential surface, an end surface, and a chamfer formed therebetween; and a photosensitive layer formed on the outer circumferential surface of the cylindrical body;

wherein the photosensitive layer covers the chamfer, the chamfer has a surface roughness larger than the outer circumferential surface, and the chamfer and the end surface have an arithmetic mean roughness Ra of not less than 0.100 μm and not more than 1.00 μm.

2. The electrophotographic photosensitive member according to claim 1, wherein the outer circumferential surface has an arithmetic mean roughness Ra of not less than 0.010 μm and not more than 0.050 μm, and wherein the chamfer has an arithmetic mean roughness Ra of not less than 0.100 μm.

3. The electrophotographic photosensitive member according to claim 1, wherein the photosensitive layer has an end extended to the end surface, wherein the end surface has a surface roughness larger than the outer circumferential surface.

4. The electrophotographic photosensitive member according to claim 3, wherein the outer circumferential surface has an arithmetic mean roughness Ra of not less than 0.010 μm and not more than 0.050 μm, and wherein the end surface has an arithmetic mean roughness Ra of not less than 0.100 μm.

5. The electrophotographic photosensitive member according to claim 3, wherein the outer circumferential surface has an arithmetic mean roughness Ra of not less than 0.010 μm and not more than 0.050 μm, and each of the end surface and the chamfer has an arithmetic mean roughness Ra of not less than 0.100 μm.

6. The electrophotographic photosensitive member according to claim 3, wherein the end surface has a surface roughness smaller than the chamfer.

7. The electrophotographic photosensitive member according to claim 3, wherein the end surface has a surface roughness larger than the chamfer.

8. The electrophotographic photosensitive member according to claim 1, wherein the chamfer is a corner flat surface having a crossing angle relative to the outer circumferential surface, the crossing angle being set to not less than 30 degrees and not more than 60 degrees.

9. The electrophotographic photosensitive member according to claim 1, wherein the chamfer is a rounded surface having a curvature radius set to not less than 0.1 mm and not more than 1.5 mm.

10. The electrophotographic photosensitive member according to claim 1, wherein the photosensitive layer includes a photoconductive layer comprising a non-single crystal material having silicon atom as a base.

11. The electrophotographic photosensitive member according to claim 10, wherein the photosensitive layer further includes a surface layer comprising a non-single crystal silicon material containing at least not less than 50 atom % of carbon.

12. An image forming apparatus provided with the electrophotographic photosensitive member according to claim 1.

* * * * *